US008196260B2

(12) United States Patent
Danko

(10) Patent No.: US 8,196,260 B2
(45) **Date of Patent: *Jun. 12, 2012**

(54) VIRTUAL HINGE

(76) Inventor: Peter Danko, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/702,285

(22) Filed: Feb. 8, 2010

(65) Prior Publication Data

US 2010/0132158 A1 Jun. 3, 2010

Related U.S. Application Data

(63) Continuation of application No. 11/382,892, filed on May 11, 2006, now Pat. No. 7,657,971.

(51) Int. Cl.
*E05D 11/10* (2006.01)

(52) U.S. Cl. ..... 16/320; 220/230; 312/221

(58) Field of Classification Search ..... 16/320, 16/254, 260, 225; 206/542, 818, 823; 220/810, 220/845, 230, 4.21, 4.22, 4, 24; 132/294–295; 312/138.1, 219, 221, 204, 230, 245, 305, 312/405, 406

See application file for complete search history.

(56) References Cited

U.S. PATENT DOCUMENTS

| | | | | |
|---|---|---|---|---|
| 1,873,534 | A | 8/1932 | Brethen | |
| 2,615,738 | A | 10/1952 | Johnson | 287/96 |
| 2,627,423 | A | 2/1953 | Copeman | 280/33.15 |
| 3,152,716 | A | 10/1964 | Feldhahn | 220/31 |
| 3,264,678 | A | 8/1966 | Parmelee | 16/128 |
| 3,287,760 | A | 11/1966 | Moore | 16/171 |
| 3,477,176 | A | 11/1969 | Tansley | 49/7 |
| 3,571,973 | A | 3/1971 | Roberts | 49/2 |
| 3,707,017 | A | 12/1972 | Paquette | 12/170 |
| 3,730,577 | A | 5/1973 | Shanok et al. | 292/251.5 |
| 4,269,486 | A | 5/1981 | Shintani | 350/486 |
| D263,721 | S | 4/1982 | Miller | D16/135 |
| 4,434,524 | A | 3/1984 | Gilchrist | 16/250 |
| 5,076,742 | A | 12/1991 | Lee et al. | 408/112 |
| 5,255,006 | A | 10/1993 | Pappas et al. | 343/915 |
| 5,398,376 | A * | 3/1995 | Pollack | 16/225 |
| 5,862,848 | A | 1/1999 | Beall | 144/372 |
| 5,992,807 | A | 11/1999 | Tarulli | 248/206.5 |
| 6,196,232 | B1 * | 3/2001 | Chkadua | 131/222 |
| 6,553,626 | B2 | 4/2003 | Coburn | 16/386 |
| 2002/0153376 | A1 * | 10/2002 | Seidler | 220/230 |

FOREIGN PATENT DOCUMENTS

DE 202004007127 U1 * 9/2004

OTHER PUBLICATIONS

International Search Report and Written Opinion of the International Searching Authority for Patent Cooperation Treaty (PCT) international application no. PCT/US06/18461.

* cited by examiner

*Primary Examiner* — Chuck Y. Mah
(74) *Attorney, Agent, or Firm* — Steptoe & Johnson LLP

(57) ABSTRACT

A support system includes a frame member and a cover magnetically coupled to one another proximate an edge of the cover and in an aligned state. The cover is rotatable with respect to the frame member without any structural coupling therebetween while the frame member and cover remain substantially in the aligned state. A method of supporting a cover with respect to a frame includes magnetically attracting the cover and frame to each other proximate an edge of the cover.

10 Claims, 6 Drawing Sheets

VIRTUAL HINGE

CROSS-REFERENCE TO RELATED APPLICATIONS

This application is a continuation of U.S. patent application Ser. No. 11/382,892 filed May 11, 2006 now U.S. Pat. No. 7,657,971, which in turn claims the benefits of Provisional Application No. 60/680,020 filed May 12, 2005 and entitled "Virtual Hinge" under 35 U.S.C. §119(e), and the entire contents of these prior applications are expressly incorporated herein by reference thereto.

FIELD OF THE INVENTION

The invention relates primarily to product design and, in particular, a hinging device that utilizes magnets configured for the magnetic coupling of a cover to a support, used for example to form cabinets, boxes and other coverable spaces.

BACKGROUND OF THE INVENTION

Structural coupling devices such as hinges have existed for many centuries. The concept of a mechanical hinge largely involves extended parts pivoting around a pin. In recent years, modern mechanical hinges have grown in complexity, and the idea of hiding hinges for decorative purposes has evolved in many directions, some of which are known in the trade as European hinges, 35 mm hinges, and SOSS hinges. Each of these hinges uses, in one fashion or another, one or more pins incorporated in a device with two extensions so that the pin defines a pivot axis about which the extensions can rotate. In the case of a hinge with planar extensions, those extensions typically are attached on one side to a support structure and on another side to a structure intended to pivot. In a cabinet, for example, one extension on the hinge may be fastened to the section of the cabinet designed to contain items. This cabinet section is usually attached to a floor, wall, or other larger structure so as to be immovable. In addition, the second extension about the pin may be attached to the door of the cabinet so that once attached, the door is also able to rotate about an axis defined by the pin.

It is also well known that such hinging devices must be physically attached to the door via screws, nails, rivets, or welding. It is further known that a degree of skill, time and precision is required to attach doors to their respective frames. Once a door is attached to a frame, the pivot axis typically is permanently set. Thus, for example, it is not typical to change the location of the pivot axis with respect to the frame—attached to the right or left side of the frame—because of the established location of the fasteners for the hinge. Tasks requiring removal of the door from the structure, e.g. for cleaning or refurbishing, may be tedious because of the fastened nature of the door with respect to the hinged coupling. Moreover, once a door is attached to a frame, it is impractical to remove the door for any desirable aesthetic purposes because of the visibility of the hinge and/or the holes in the frame where the hinge was fastened.

Many modern hinges also incorporate the use of springs to automatically return a door to its closed position. While the state of the art includes magnets that can lock a door to its support, these magnets do not have any appreciable potential to return the door to its closed state or otherwise support the door without any structural coupling between the door and surrounding structure.

There exists a need for systems and methods for supporting a door with respect to a frame or other structure. In particular, there exists a need for systems and methods in which magnetic fields are used to attract the door to a frame or other structure in lieu of an actual physical pin, spring, and/or socket coupling. Thus, there exists a need for a virtual hinge that requires no actual hardware to attach or otherwise fix a door to another structure.

SUMMARY OF THE INVENTION

The invention relates to a support system including a frame member and a cover magnetically coupled to one another proximate an edge of the cover and in an aligned state. The cover may be rotatable with respect to the frame member without any structural coupling therebetween while the frame member and cover remain substantially in the aligned state.

The frame member may have a first magnet and the cover may have a second magnet, with the first and second magnets being disposed adjacent to one another. Moreover, the first and second magnets may be disposed to define an axis of rotation of the cover with respect to the frame member which may be movable while the frame member and cover remain substantially in the aligned state. The edge of the cover may have an arcuate profile.

The cover may be formed of a non-magnetic plastic body which may be corrugated. The first magnet may be embedded within material of the frame member and/or the second magnet may be embedded within material of the cover.

In one exemplary embodiment, one of the frame member and the cover may include a magnet and the other of the frame member and the cover may be formed of a magnetic material. The frame member and cover may be disposed to define an axis of rotation of the cover with respect to the frame member, and the axis of rotation may be movable while the frame member and cover remain substantially in the aligned state. The cover may be formed of a polymeric material with the magnet coupled thereto. For example, the cover may be formed of a corrugated body. Also, for example, the magnet may be embedded within structure of the frame member or structure of the cover.

In another exemplary embodiment, the frame member and the cover each may be formed of a magnetic material, and the frame member and the cover may be coupled to one another by sufficient magnetic force to resist movement of the cover from the aligned state by gravitational force.

The invention further relates to a cabinet including a frame and a cover magnetically coupled to one another proximate an edge of the cover and in an aligned state, wherein the cover is rotatable with respect to the frame without any structural coupling therebetween while the frame and cover remain substantially in the aligned state.

The frame may have a first magnet and the cover may have a second magnet, the first and second magnets disposed adjacent to one another. The first and second magnets may be disposed to define an axis of rotation of the cover with respect to the frame, and the axis of rotation may be movable while the frame and cover remain substantially in the aligned state. The edge of the cover may have an arcuate profile. Also, the cover may be formed of a non-magnetic plastic body and the body may be corrugated. The first magnet may be embedded within material of the frame and/or the second magnet may be embedded within material of the cover.

In an exemplary embodiment, one of the frame and the cover may include a magnet and the other of the frame and the cover may be formed of a magnetic material. For example, the magnet may be embedded within structure of the frame or the cover. The frame and cover may be disposed to define an axis of rotation of the cover with respect to the frame, and the axis of rotation may be movable while the frame and cover remain substantially in the aligned state.

The cover may be formed of a polymeric material with the magnet coupled thereto, and the cover may be formed of a corrugated body.

In yet another exemplary embodiment, the frame and the cover each may be formed of a magnetic material, and the frame and the cover may be coupled to one another by sufficient magnetic force to resist movement of the cover from the aligned state by gravitational force.

In yet another exemplary embodiment, the cover may have a magnet and the frame may be formed of a material to which the magnet is attracted.

The frame may form an opening and the edge of the cover may be disposed in the aligned state with respect to at least two edges of the opening. Further, the opening may be rectangular and the at least two edges of the opening may be two edges of the opening disposed parallel to one another. The frame may have two stiles and the cover may be magnetically coupled to the frame proximate either of the stiles.

The invention also relates to a method of adapting a framed storage space comprising: magnetically coupling a frame and a cover to one another proximate an edge of the cover and in an aligned state, wherein the cover is rotatable with respect to the frame without any structural coupling therebetween while the frame and cover remain substantially in the aligned state. The method may further comprise: moving the edge of the cover from proximate the first stile of the frame to proximate the second stile of the frame. The cover may be magnetically coupled to the frame in the aligned state when the edge of the cover is disposed either proximate the first stile or proximate the second stile. In addition, the cover may be sized to overlie an opening defined by the frame when the cover is disposed flush with a front side of the frame. Alternatively, the cover may be sized to fit within an opening defined by the frame.

A magnet may be coupled to the cover proximate an edge thereof and the method may further include disposing the magnet proximate an edge of the frame so that the edge of the cover and the edge of the frame are magnetically attracted to one another. The cover and frame may be disposed to define an axis of rotation of the cover with respect to the frame, and the axis of rotation may be movable while the frame member and cover remain substantially in the aligned state. The frame and the cover may be coupled to one another by sufficient magnetic force to resist movement of the cover from the aligned state by gravitational force.

Through magnetic attraction of a door with respect to a frame or other structure, an imaginary axis of rotation may be created about which the door may swing while remaining in a desired alignment. The imaginary axis of rotation may be substantially located where a physical hinge otherwise would be found.

As a matter of course, such a virtual hinge makes hanging a door with respect to a frame member an instant event wherein the edge of the door is simply moved or placed in proximity to an opening or other space defined in part by the frame member. Once in general alignment, magnetic attraction between the edge of the door and the frame member create an imaginary axis of rotation. In one embodiment, the door and frame member each include magnets which attract each other and are aligned to interact with each other. In another embodiment, one of the door and frame member may be formed of a material to which magnets in the other of the door or frame are attracted. The material may be metal. In yet another embodiment, the door and frame each may be formed of magnetic materials that are attracted to one another, thus obviating the need for discrete magnets to be disposed in either the door or frame.

By engaging the magnetic fields, the door simply jumps to its frame so as to be positioned in its rotatable position. The virtual hinge also acts as a self closing device, to return the door to its closed position without the use of an actual spring. Finally, the virtual hinge need not be seen on either the door or the frame of the enclosure. For example, magnets may be impregnated or otherwise disposed within the edge of the door or the frame member and thus may not be readily visible.

The invention further relates to an enclosure that includes three elements. The first element is a container with a back surface, side surfaces that trace the circumference of the container and that are attached to the back surface and a front surface that is attached to the side surfaces at its edge and that has an opening. The second element is a set of magnets, preferably located within at least one edge of the front surface of the container and within at least one edge of the cover so as to align with the first magnet or set of magnets and interact through magnetic fields so that one or both sets of magnetically attracting materials act as a hinge when the separate surface is rotated about the edge where the sets of magnetically attracting materials are located. The third element is a separate surface sized to attach to the front surface of the container so as to cover the opening.

In some embodiments, the magnets may be oriented so that magnetically attracting materials automatically bring an open door to a closed position. The magnets are easily separated from each other so that the cover is easily detachable from the container and may be readily removed by simply pulling the cover from said container. In another preferred exemplary embodiment, the magnets facilitate covering of a region so that, in the case of a door, the door can be hung to a suitable container without the use of tools, by action of aligning a first set of magnetically attracting materials with a second set of magnetically attracting materials, each set associated with either the door or surrounding structure of the container, until the magnetic field(s) engage, thereby pulling and fixing the door to proper placement.

In yet another exemplary embodiment the magnets allow for removal of the cover and replacement in a different position so as to either reverse the cover about a center horizontal diametric axis so that the opposite surface of the cover is facing away from the container or reverse the cover about center vertical diametric axis so that, in the case of a door, a door that once opened horizontally may now open vertically. This can be achieved by either attaching the opposite side of the cover to the same edge of the front surface of the container or by use of a third set of magnetically attracting materials such that their placement is symmetrically opposite the second set of magnetically attracting materials, and the door hinge is rotated so that the magnetic fields of the first and third sets of magnetically attracting materials align to pull and fix the door or covering to proper placement.

In still another exemplary embodiment of the invention, magnets are embedded (or hidden) in the material of the container, the cover, or both the container and cover so as to conceal their presence from view. An exemplary, non-limiting example of such an embodiment includes a cover that may be removed from the front surface of a container without discernible evidence of the magnetically attracting materials in the door frame, or visible evidence of hardware, or holes or indentations in the door frame. In each such exemplary embodiment of the invention, the magnets provide the force necessary to prevent the cover from decoupling due to gravitational forces, thus obviating the need for a flange or other device not so easily and fully concealable.

The invention additionally relates to an enclosure that includes a container having a back surface, side surfaces that trace the circumference of the container and that are attached to the back surface, and a front surface that is attached to the side surfaces at its edge and that has an opening. The enclosure further includes: a first magnet or set of magnets that reside within at least one edge of the front surface of the container, a separate surface sized to attach to the front surface of the container so as to cover the opening, and a second magnet or set of magnets that reside within at least one edge of the cover so as to align with the first magnet or set of magnets and create a magnetic field so that one or both sets of magnetically attracting materials act as a hinge when the separate surface is rotated about the edge where the sets of magnetically attracting materials are located.

A method for providing an alternative to hinges for hanging a door, either vertically or horizontally, involves the use of adjacent interacting magnetic fields that in effect create a rotational axis similar to that formed by a physical hinge. A virtual hinge involves pairs of magnets that are inserted along a frame member and its respective door. These pairs of magnets are in an approximate distance such that their respective magnetic fields interact to behave much the same way a hinge works when a door is opened or closed. The magnetic fields of the virtual hinge also may behave as a spring to act as a self closing mechanism. The virtual hinge may be instantly installed or removed as desired or reversed to hang on an opposite stile, the vertical or upright framing pieces of the cabinet face frame.

BRIEF DESCRIPTION OF THE DRAWINGS

Preferred features of the present invention are disclosed in the accompanying drawings, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Referring now to FIGS. 1-6, preferred exemplary embodiments of the present invention are shown with three basic elements that cooperate to create a structure that can assume the role of a container 1 with a cover 3. In each depiction of the embodiment, cover 3 is magnetically coupled to container 1 using magnets 2.

Figure 1:
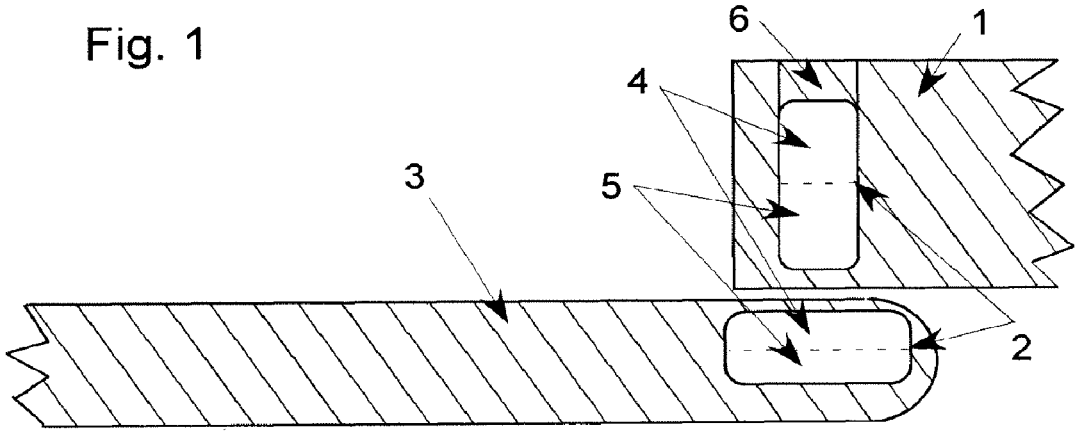
FIG. 1 is a partial cross-sectional view perpendicular to the cover showing orientation and placement of magnets.

FIG. 1 depicts the placement of magnets 2 in further detail. Preferably, once aligned properly, one or more magnets attached to container 1 and one or more magnets attached to cover 3 will each become polarized so that each magnet 2 will have a first polarity 4 and a second polarity 5 (as delineated, for example, by the dashed line in each magnet). As is well known in the magnetic art, the first polarity 4 of one magnet 2 and the second polarity 5 of the other magnet 2, once aligned, may create a force capable of holding the cover 3 flush with the front face of the cabinet 1 so as to cover its opening (i.e., the north and south attractions of the respective magnets). In addition, the same magnetic effect, also well known in the art, can provide the force necessary to close the cover 3 so that it returns to a state where the cover 3 is flush with the front surface of the cabinet 1 without the application of external force.

As shown in the exemplary embodiment of FIG. 1, each of magnets 2 in an aligned pair may be disposed for example with their major axes perpendicular to one another when the cover 3 is positioned as shown, with the magnets attracting one another. In this embodiment, a ¼ inch dimension at polarity 5 may be attracted to a ½ inch dimension at polarity 4.

Figure 1A:
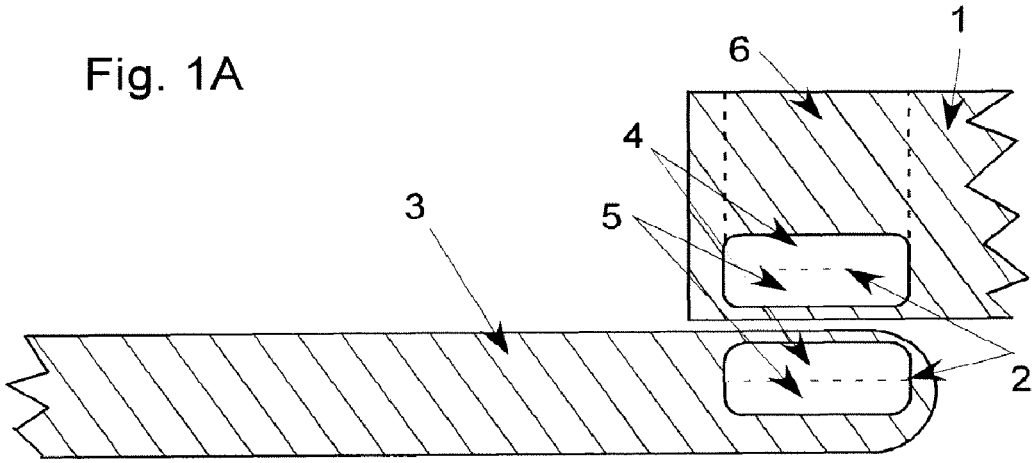
FIG. 1A is a partial cross-sectional view perpendicular to the cover showing another orientation and placement of magnets.
Figure 2:
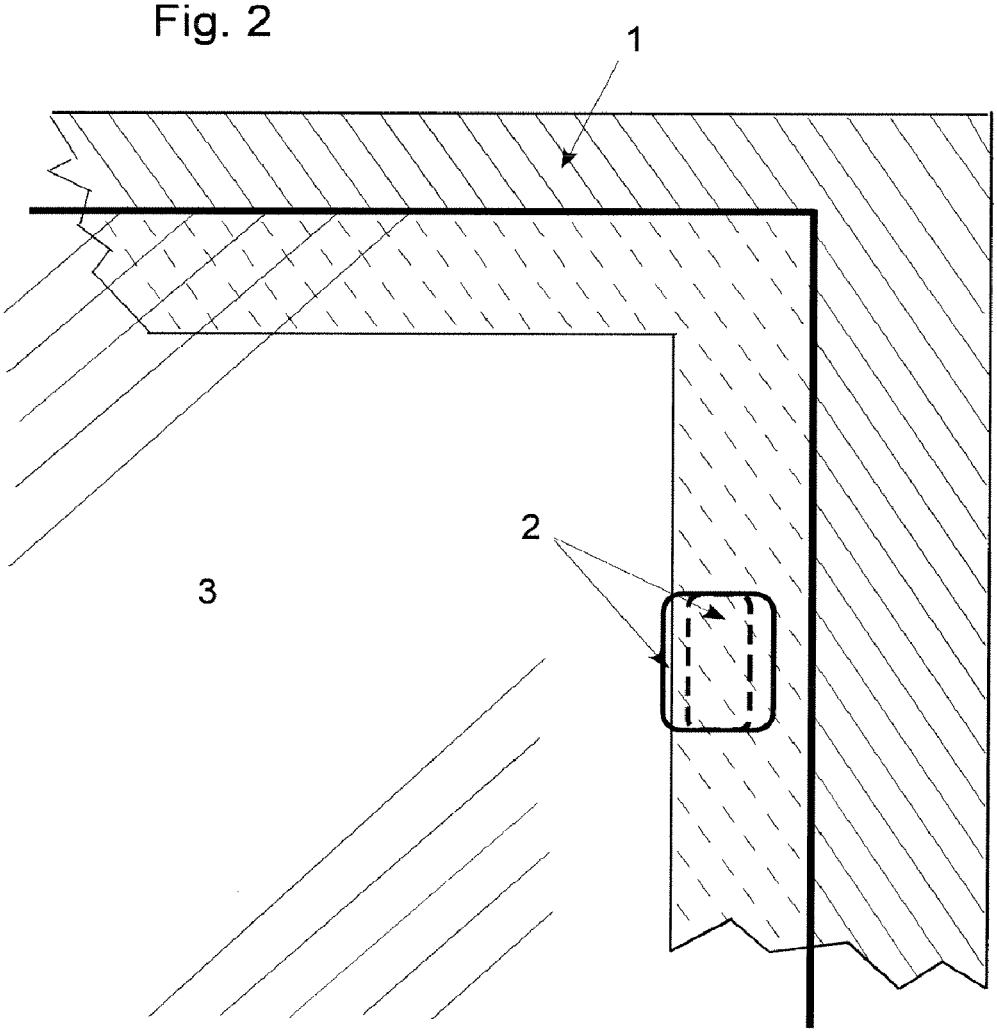
FIG. 2 is partial a cross-sectional view rotated 90° from FIG. 1 and parallel to the cover.
Figure 3:
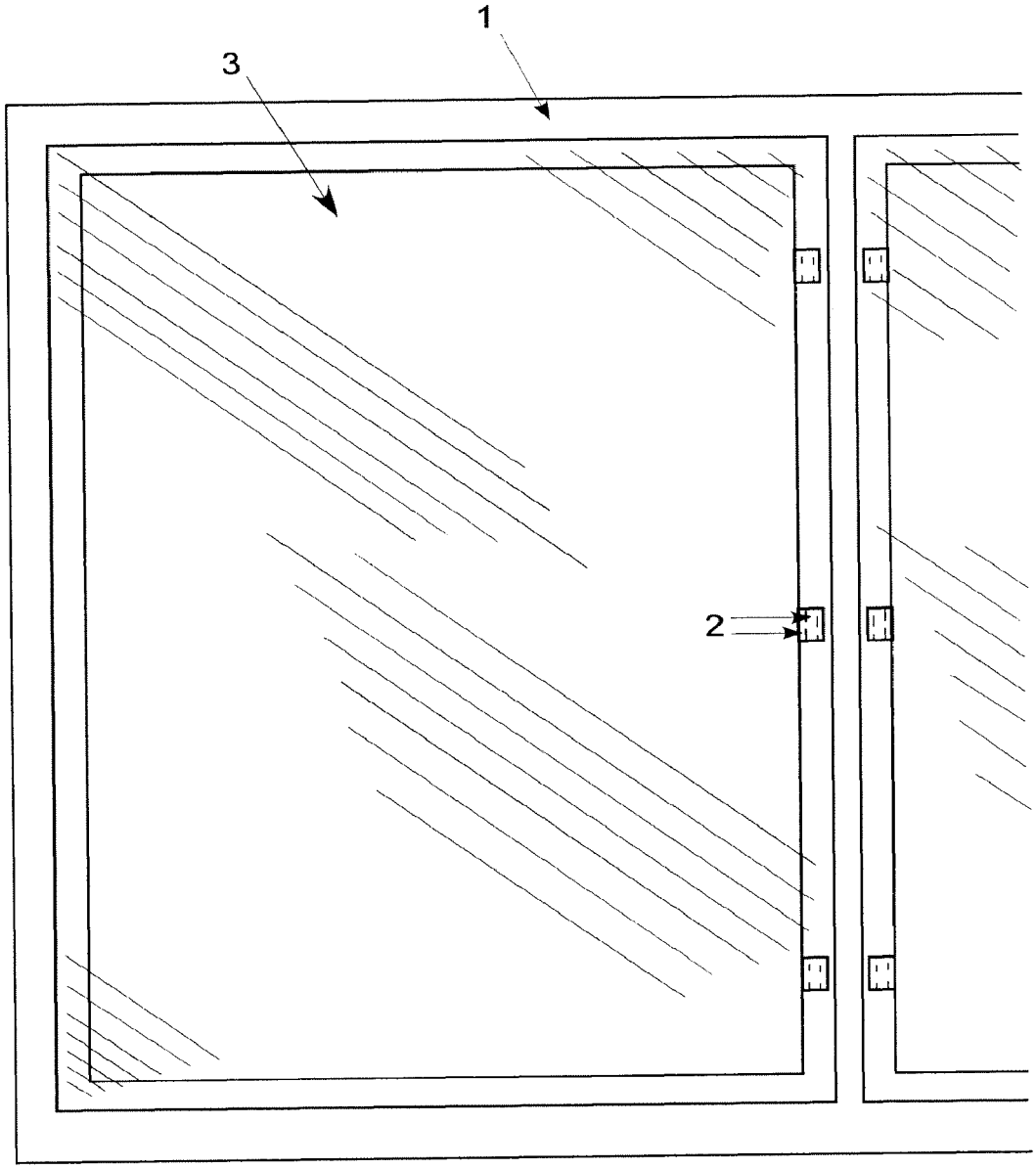
FIG. 3 is an expanded view of FIG. 2, and illustrates the use of the magnets in series within both the cover and the container to arrange the covers, or doors, adjacent to each other.
Figure 4:
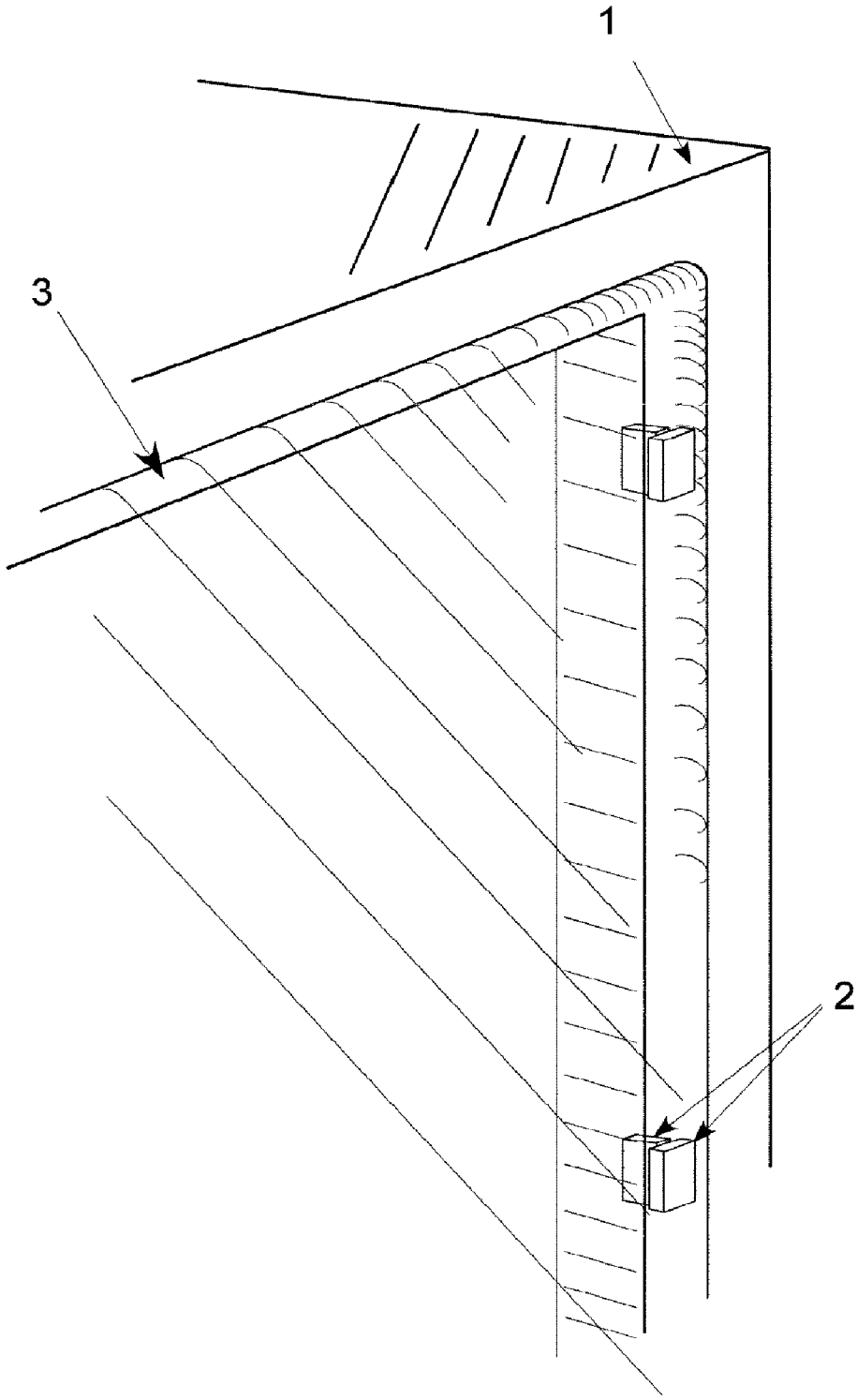
FIG. 4 is a perspective view of the embodiment depicted in FIG. 3 showing the placement of magnets in both the container and the cover and the orientation of components with respect to each other.
Figure 5:
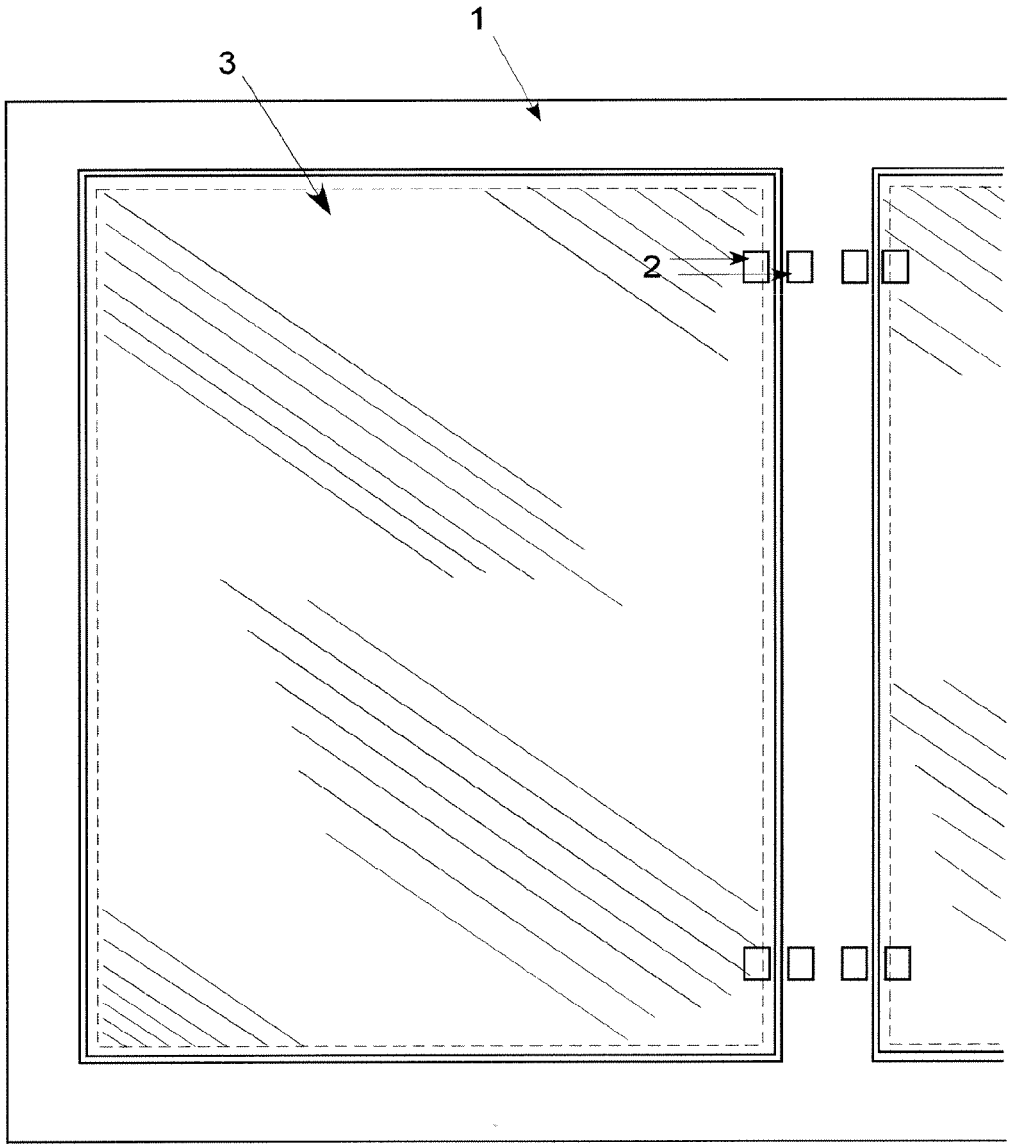
FIG. 5 shows an embodiment where an inset cover, or door, is flush with the outside of the container.

In another exemplary embodiment, shown in FIG. 1A, each of magnets 2 in an aligned pair may be disposed for example with their major axes parallel to one another when the cover 3 is positioned as shown, with the magnets attracting one another. In this embodiment, a ¼ inch dimension at polarity 5 may be attracted to a ¼ inch dimension at polarity 4.

Although generally block rectangular magnets have been shown with different lengths and widths, in yet another exemplary embodiment the magnets may be square. Moreover, cylindrical magnets, half-cylindrical magnets (i.e. cylinders split in half along their longitudinal axis), or partial cylindrical magnets may be used, and for example may be magnetized along the length of the cylindrical portion.

Figure 6:
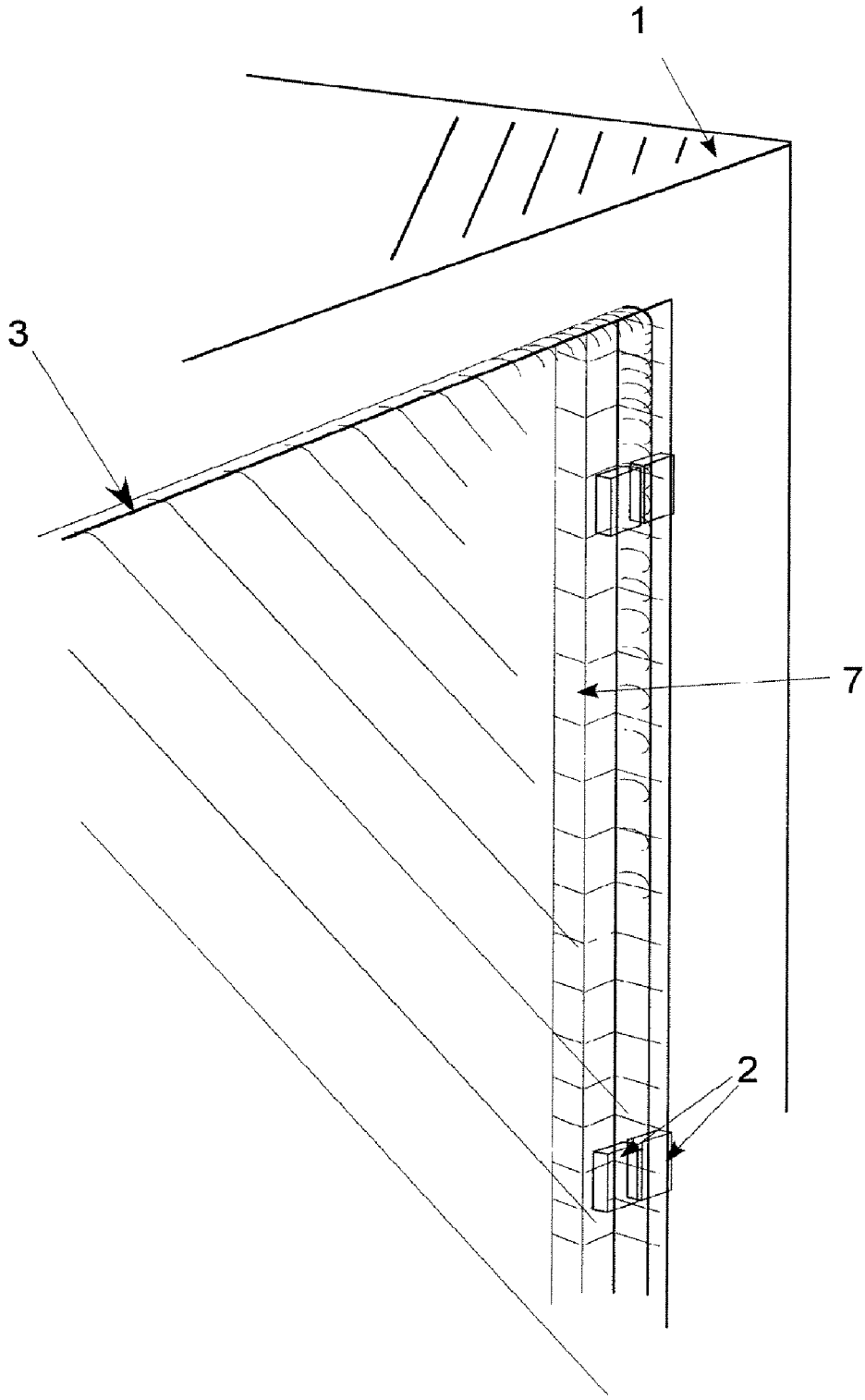
FIG. 6 is a perspective view of the embodiment depicted in FIG. 5, where an inset cover, or door, is flush with the outside of the container.

In one exemplary embodiment, the container 1 is a cabinet and the cover 3 is the door to the cabinet 1. In a preferred exemplary embodiment, magnets 2 are placed along or hidden within at least one edge of a lip 7, as seen in FIG. 6, proximate the front surface of the cabinet. Magnets 2 are also placed along or hidden within one edge of the door to the cabinet. In this embodiment, the door is coupled to the cabinet by allowing the magnets 2 to align with each other by properly placing the door on to the front surface of the cabinet. Preferably, the magnetic force that attracts the magnet(s) in the door to its counterpart(s) in the cabinet is selected to be a force greater than the weight of the door (the gravitational force tending to otherwise cause the door to fall away from the frame member of the cabinet) so as to prevent the door from slipping vertically. Likewise, the magnetic force that attracts the magnet(s) in the door to its counterpart(s) in the structure of the cabinet will preferably be of a strength not so great that it is difficult to open the door for normal use. In some exemplary embodiments, preferably the magnetic force is large enough to prevent the cover 3 from opening without exceptional effort on the part of the entity, or thing, opening the cover 3. Thus, the door is rotatable with respect to the cabinet frame without any structural coupling therebetween while the cabinet frame and cover remain substantially in an aligned state with an edge of the cover magnetically coupled to the cabinet frame and preferably proximate an opening thereof.

In an exemplary embodiment with aligned magnets in a door and frame, the axis of rotation may be movable because its location may change as one magnet of each pair is rotated with respect to the other magnet of each pair as when a door is opened or closed with respect to the frame.

In another exemplary embodiment, the cover 3 is configured so that the edge closest to the magnets 2 is rounded or otherwise shaped to allow for easy rotation of the cover 3 proximate the magnets 2. As seen in FIG. 1, in which an edge of cover 3 is provided with an arcuate profile proximate a magnet 2, a preferred property of such rotation is that the axis of rotation not remain in a fixed position along the length of the cover 3. Instead, the rounded outer edge of the cover 3 will move slightly closer to the magnet 2 in the container 1. By way of non-limiting exemplary embodiment, in the cabinet described above, the magnet 2 attached to the door may rotate 90 degrees as the door opens. At 90 degrees, the magnet in the door is perpendicular to the magnet in the structure of the cabinet. The result is a magnetic field similar to the one created when the door is closed (at a zero degree angle with respect to the front surface of the cabinet) so that both magnets are polarized so as to create a stable magnet field capable of holding the door in an open position. In one embodiment, a slight disturbance from this stable state preferably may result in a closing of the door. It is noteworthy that in certain preferred embodiments, it is possible and/or preferable that when the door is disturbed from a stable magnetic state, the magnetic field between the magnets 2 will result in the full opening of the door.

By way of example, and without limitation, magnets may be permanent magnets formed of rare earth magnetic materials such as neodymium (Nd—Fe—B) blocks of types commercially available from a variety of retail sources, such as Master Magnetics, Inc./The Magnetic Source™. It has been found that such magnets periodically spaced in a cabinet produce sufficient force to operate with magnets correspondingly aligned in a door made of 10 mm non-magnetic corrugated plastic sheet such as Coroplast™ extruded twinwall thermoplastic sheet formed, for example, of high impact polypropylene copolymer. It will be readily appreciated that this example of magnet and door materials is by way of example only, and that many other materials, shapes, dimensions, weights, alignments, and other factors may be used.

In one preferred exemplary embodiment of the present invention, a door formed of white oak wood (with plastic light panels set therein) and weighing about 15 pounds and having dimensions of about 76.5 inches high, about 24.5 inches wide, and about 1.125 thick is installed with respect to a wood frame using magnets disposed proximate and within an edge of the door and corresponding magnets disposed proximate and within the frame. The magnets are disposed to attract one another, as explained previously. In particular, for each aligned and interacting pair of magnets in the door and frame, the magnets may be separated from one another, for example, by about ¼ inch, and thus preferably are embedded within the wood of each of the door and frame by about ⅛ inch. The magnets may be disposed in the door and frame, for example, in the orientation of FIG. 1A. To support a door of such dimensions and weight, the magnets for example may be selected as nickel plated neodymium block magnets having the following specifications: Grade 35 Mega Gauss Oersteds (MGO), about 0.5 inch thick, about 2 inches long, and about 2 inches wide, weighing about 0.534 lbs. (Master Magnetics, Inc./The Magnet Source™ Part No. NB058N-35). In a preferred exemplary embodiment, four magnets are each embedded at distances along the long sides of the door and frame of about 3 inches and about 29 inches from each of the top and bottom thereof (for a total of eight magnets to support the door). Nickel plating of the magnets assists in corrosion resistance thereof.

In another preferred exemplary embodiment of the present invention, a kitchen cabinet door formed of Coroplast™ extruded twinwall thermoplastic sheet and weighing about one pound and having dimensions of about 24 inches high, about 14 inches wide, and about 1 centimeter thick is installed with respect to a wood frame using magnets disposed proximate and within an edge of the door and corresponding magnets disposed proximate and within the frame. The magnets are disposed to attract one another, as explained previously. In particular, for each aligned and interacting pair of magnets in the door and frame, the magnets may be separated from one another, for example, by about 0.1 inch, and thus preferably are embedded within the plastic sheet of the cabinet door and the wood frame by about 0.05 inch. The magnets may be disposed in the cabinet door and frame, for example, in the orientation of FIG. 1; each pair may have magnets of different specifications. To support a cabinet door of such dimensions and weight, the magnets for example may be selected as nickel plated neodymium block magnets having the following specifications: (1) Grade 27 MGO, about 0.25 inch thick, about 0.75 inches long, and about 0.5 inches wide, weighing about 0.025 lbs. (Master Magnetics, Inc./The Magnet Source™ Part No. NB25575-27); and (2) Grade 30 MGO, about 0.5 inch thick, about 0.75 inches long, and about 0.25 inches wide, weighing about 0.025 lbs. (Master Magnetics, Inc./The Magnet Source™ Part No. NB502575-30). In a preferred exemplary embodiment, three magnets are each embedded at distances along the long sides of the door and frame of about 3.5 inches from each of the top and bottom thereof and about 12 inches from both the top and bottom thereof in the center (for a total of six magnets to support the cabinet door).

Use of very lightweight thermoplastic sheet in connection with the present invention, for example to form cabinet doors, provides a measure of safety to the door/frame systems. If a door were to fall away from a frame due to application of a force in excess of the supporting magnetic forces in the system, the polymeric door would have small enough weight so as not to cause injury if a person were hit by it and also substantial damage to the door may be avoided in the event of impact for example with the floor.

In embodiments in which magnets are embedded into a door and/or frame, the magnets must be sufficiently secured in place so that they do not pull out from their surrounding structure and possibly damage the structure as a result. Thus, for example, the magnets may be placed a sufficient distance from the surface of the edge of a door and/or frame so that they do not pull out.

A variety of door and frame materials are contemplated for use with the magnets of the present invention including, for example, polymers, wood, aluminum, and steel.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For example, while cabinets are disclosed herein, the magnetic coupling of a door to a frame or other support is generally contemplated and thus the invention is not limited to forming fully enclosed spaces. Moreover, in some embodiments the axis of rotation may be substantially fixed in position while the frame member and cover remain substantially in the aligned state. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A cabinet support system comprising:

a frame member having a first end and a second end; and a cover comprising an edge portion defined between a first end and a second end;

wherein the cover and the frame member are magnetically coupled to one another proximate the edge portion of the cover while the edge portion is disposed in an aligned state with respect to the frame member;

wherein the cover is rotatable with respect to the frame member without any structural coupling therebetween while the frame member and cover remain substantially in the aligned state;

wherein the cover is rotatable with respect to the frame member and magnetically coupled thereto when either of the first end and the second end of the edge portion are disposed closer to the first end of the frame member than the second end of the frame member; and wherein each of the frame member and the cover comprises material selected from the group consisting of a magnet and magnetic material.

2. The cabinet support system of claim 1, wherein at least one of the frame member and the cover have a magnet coupled thereto.

3. The cabinet support system of claim 1, wherein the frame member comprises a first magnet and the cover comprises a second magnet, the first and second magnets disposed adjacent to one another.

4. The cabinet support system of claim 3, wherein the first and second magnets are disposed to define an axis of rotation of the cover with respect to the frame member.

5. The cabinet support system of claim 4, wherein the axis of rotation is movable while the cover remains substantially in the aligned state.

6. The cabinet support system of claim 1, wherein the edge portion of the cover comprises an arcuate profile.

7. The cabinet support system of claim 1, wherein the cover further comprises a non-magnetic plastic body.

8. The cabinet support system of claim 7, wherein the body is corrugated.

9. The cabinet support system of claim 1, wherein one of the frame member and the cover comprises a magnet and the other of the frame member and the cover is formed of a magnetic material.

10. A cabinet comprising:

a frame defining an open space and comprising a vertical stile having a magnet coupled thereto; and a cover comprising a first surface and an opposing second surface, the cover being magnetically coupled to the frame proximate the stile, proximate an edge of the cover, and in an aligned state with respect to the stile;

wherein the frame and cover are positionable such that either of the first and second surfaces of the cover can face the open space when the cover is magnetically coupled to the frame proximate the stile; and wherein the cover is rotatable with respect to the frame without any structural coupling therebetween while the cover remains substantially in the aligned state.

* * * * *